US012448887B2

(12) United States Patent
Temer et al.

(10) Patent No.: US 12,448,887 B2
(45) Date of Patent: Oct. 21, 2025

(54) METHOD AND SYSTEM FOR AUTOMATED MULTI-ZONE DOWNHOLE CLOSED LOOP RESERVOIR TESTING

(71) Applicant: Schlumberger Technology Corporation, Sugar Land, TX (US)

(72) Inventors: Elias Temer, Chatenay-Malabry (FR); Carlos Merino, Bagneux (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/815,108

(22) Filed: Aug. 26, 2024

(65) Prior Publication Data

US 2024/0418084 A1 Dec. 19, 2024

Related U.S. Application Data

(62) Division of application No. 18/254,240, filed as application No. PCT/US2021/061133 on Nov. 30, 2021, now Pat. No. 12,098,633.

(30) Foreign Application Priority Data

Nov. 30, 2020 (EP) ..... 20306465

(51) Int. Cl.
*E21B 49/08* (2006.01)
*E21B 33/122* (2006.01)
(Continued)

(52) U.S. Cl.
CPC ..... *E21B 49/087* (2013.01); *E21B 33/122* (2013.01); *E21B 34/06* (2013.01);
(Continued)

(58) Field of Classification Search
CPC ..... E21B 33/124; E21B 49/087; E21B 47/06; E21B 47/14; E21B 43/162; E21B 43/11; E21B 43/12; E21B 43/25
See application file for complete search history.

(56) References Cited

U.S. PATENT DOCUMENTS 3,170,520 A * 2/1965 Arutunoff ..... E21B 43/14 166/185
3,679,264 A * 7/1972 Van Huisen ..... E21B 43/24 165/45

(Continued)

FOREIGN PATENT DOCUMENTS

EP 2876256 A1 5/2015
GB 2550864 A 12/2017

(Continued)

OTHER PUBLICATIONS

International Search Report and Written Opinion issued in the related PCT Application PCT/US2014/037023, dated Nov. 24, 2014 (10 pages).

(Continued)

*Primary Examiner* — Kenneth L Thompson
(74) *Attorney, Agent, or Firm* — Jeffrey D. Frantz

(57) ABSTRACT

A well testing system and method is disclosed that reduces the surface equipment needed for well testing by providing a closed loop fluid flow path where the fluids produced during the well test are not brought to the surface for storage or flaring but instead are disposed in a downhole zone. The system and method are implemented using a simplified acoustic communications network where a hub device generates and transmits a single multiple hop query that includes multiple commands or queries directed to targeted downhole tools.

7 Claims, 8 Drawing Sheets

(51) Int. Cl.

| | |
|---|---|
| ***E21B 33/124*** | (2006.01) |
| ***E21B 34/06*** | (2006.01) |
| ***E21B 43/11*** | (2006.01) |
| ***E21B 43/12*** | (2006.01) |
| ***E21B 47/06*** | (2012.01) |
| ***E21B 47/14*** | (2006.01) |

(52) U.S. Cl.
CPC ..... *E21B 43/128* (2013.01); *E21B 47/06* (2013.01); *E21B 47/14* (2013.01)

(56) References Cited

U.S. PATENT DOCUMENTS

| | | | | |
|---|---|---|---|---|
| 5,335,732 | A * | 8/1994 | McIntyre | E21B 33/124 166/387 |
| 5,887,652 | A | 3/1999 | Beck | |
| 6,330,913 | B1 | 12/2001 | Langseth | |
| 6,357,525 | B1 | 3/2002 | Langseth et al. | |
| 6,543,540 | B2 | 4/2003 | Woie et al. | |
| 6,598,682 | B2 | 7/2003 | Johnson et al. | |
| 7,363,972 | B2 * | 4/2008 | Dybdahl | E21B 49/088 73/152.55 |
| 7,478,555 | B2 | 1/2009 | Zhan | |
| 7,921,714 | B2 * | 4/2011 | Duguid | E21B 49/10 73/152.57 |
| 8,196,651 | B2 * | 6/2012 | Murphy | E21B 43/006 166/305.1 |
| 8,570,832 | B2 | 10/2013 | Rayssiguier | |
| 8,750,075 | B2 | 6/2014 | Rayssiguier et al. | |
| 8,994,550 | B2 | 3/2015 | Millot et al. | |
| 9,033,037 | B2 * | 5/2015 | Cens | E21B 47/10 166/250.15 |
| 9,062,535 | B2 | 6/2015 | Merino et al. | |
| 9,284,834 | B2 | 3/2016 | Alteirac et al. | |
| 9,441,479 | B2 | 9/2016 | Froelich | |
| 9,631,486 | B2 | 4/2017 | Millot | |
| 9,638,029 | B2 | 5/2017 | Merino | |
| 9,670,773 | B2 | 6/2017 | Croux | |
| 9,686,021 | B2 | 6/2017 | Merino | |
| 9,708,895 | B2 | 7/2017 | Bassett | |
| 9,790,786 | B2 | 10/2017 | Croux et al. | |
| 9,885,228 | B2 | 2/2018 | Wolf et al. | |
| 10,036,244 | B2 | 7/2018 | Rayssiguier et al. | |
| 10,047,596 | B2 | 8/2018 | Joshi | |
| 10,236,906 | B2 | 3/2019 | Probel | |
| 10,890,057 | B2 | 1/2021 | MacPhail et al. | |
| 10,900,352 | B2 | 1/2021 | Vannuffelen et al. | |
| 11,121,722 | B2 | 9/2021 | Probel | |
| 11,149,544 | B2 | 10/2021 | Deville | |
| 11,149,545 | B2 | 10/2021 | Kuchuk | |
| 11,293,281 | B2 | 4/2022 | Giordano | |
| 12,098,633 | B2 * | 9/2024 | Temer | E21B 43/128 |
| 2002/0017386 | A1 | 2/2002 | Ringgenberg | |
| 2005/0103490 | A1 | 5/2005 | Pauley | |
| 2007/0050145 | A1 | 3/2007 | Zhan | |
| 2007/0162235 | A1 | 7/2007 | Zhan | |
| 2008/0149349 | A1 | 6/2008 | Hiron | |
| 2009/0288824 | A1 * | 11/2009 | Fowler, Jr. | E21B 43/14 166/54.1 |
| 2010/0126717 | A1 | 5/2010 | Kuchuk | |
| 2011/0040536 | A1 | 2/2011 | Levitan | |
| 2011/0130966 | A1 | 6/2011 | Zhan | |
| 2011/0205847 | A1 | 8/2011 | Lemenager | |
| 2012/0250461 | A1 | 10/2012 | Millot et al. | |
| 2013/0038464 | A1 | 2/2013 | Alteirac | |
| 2014/0266769 | A1 | 9/2014 | van Zelm | |
| 2015/0077265 | A1 | 3/2015 | Gao | |
| 2016/0312579 | A1 | 10/2016 | Green et al. | |
| 2017/0149523 | A1 | 5/2017 | Li | |
| 2018/0051535 | A1 | 2/2018 | Wang et al. | |
| 2019/0128098 | A1 | 5/2019 | Ross | |
| 2019/0284933 | A1 | 9/2019 | Tiwari | |
| 2019/0390543 | A1 | 12/2019 | Merino | |
| 2020/0240265 | A1 | 7/2020 | Machocki | |

FOREIGN PATENT DOCUMENTS

| | | | |
|---|---|---|---|
| WO | 0065200 | A1 | 11/2000 |
| WO | 2009068302 | A2 | 6/2009 |
| WO | 2017196303 | A1 | 11/2017 |
| WO | 2018140844 | A1 | 8/2018 |
| WO | 2020023058 | A1 | 1/2020 |
| WO | 2020027766 | A1 | 2/2020 |
| WO | 2020027767 | A1 | 2/2020 |
| WO | 2021055931 | A1 | 3/2021 |

OTHER PUBLICATIONS

Biryukov et al., "Pressure transient solutions to mixed boundary value problems for partially open wellbore geometries in porous media", Journal of Petroleum Science and Engineering, 96-97:162-175, 2012.

Biryukov et al., "Transient Pressure Behavior of Reservoirs with Discrete Conductive Faults and Fractures", Transport in Porous Media, 95:239-268, 2012.

Booth et al., "Grid-Based Inversion of Pressure Transient Test Data", Presented at ECMORXII—12th European Conference on the Mathematics of Oil Recovery, Oxford, UK, Sep. 6-9, 2010.

Booth et al., "Grid-based Inversion of Pressure Transient Test Data With Stochastic Gradient Techniques", International Journal for Uncertainty Quantification, 2 (4):323-339, 2012.

Cipolla et al., "Seismic-to-Simulation for Unconventional Reservoir Development", SPE 146876 presented at the SPE Reservoir Characterisation and Simulation Conference and Exhibition, Abu Dhabi, UAE, Oct. 9-11, 2011.

De Brito Nogueira et al., "Integrated Workflow Characterizes Campos Basin Fractured Reservoirs Using Pressure Transient Tests", World Oil, Feb. 2013, pp. 103-106.

Guichard et al., "The First Successful Impulse Test on Coiled Tubing Results in Reliable Reservoir Evaluation for Non-naturally Flowing Wells", SPE 128429 presented at the SPE North Africa Technical Conference and Exhibition, Cairo, EG, Feb. 14-17, 2010.

Kuchuk et al., "Transient Pressure Test Interpretation for Continuously and Discretely Fractured Reservoirs", SPE 158096 presented at the SPE Annual Technical Conference and Exhibition, San Antonio, TX, USA, Oct. 8-10, 2012.

Morton et al., "Global Sensitivity Analysis for Natural Fracture Geological Modeling Parameters from Pressure Transient Tests", SPE 164894 presented at the EAGE Annual Conference Exhibition incorporating SPE Europec, London, UK, Jun. 10-13, 2013.

Morton et al., "Grid-Based Inversion Methods for Spatial Feature Identification and Parameter Estimation from Pressure Transient Tests", SPE 142996 presented at the SPE EUROPEC/EAGE Annual Conference and Exhibition, Vienna, AT, May 23-26, 2011.

Morton et al., "Integrated Interpretation for Pressure Transient Tests in Discretely Fractured Reservoirs", SPE 154531 presented at the EAGE Annual Conference Exhibition incorporating SPE Europec, Copenhagen, DK, Jun. 4-7, 2012.

International Preliminary Report on Patentability issued in the related PCT Application PCT/US2014/037023, dated Nov. 10, 2015 (6 pages).

Extended Search Report issued in the related EP Application 14794319.5, dated Dec. 6, 2016 (8 pages).

H. Aghar et al., 2007, The Expanding Scope of Well Testing, Schlumberger Oilfield Review (16 pages).

Office Action received in the MX application MX/a/US2015/015402 dated Aug. 31, 2021 (6 pages).

Office Action received in the MX application MX/a/US2015/015402 dated Dec. 28, 2021 (6 pages).

Partial Search Report issued in EP application 20306465.4, dated May 12, 2021 (14 pages).

Extended Search Report issued in EP application 20306465.4, dated Jul. 13, 2021 (13 pages).

International Search Report and Written Opinion issued in the PCT Application PCT/US2021/061133, dated Mar. 23, 2022 (12 pages).

(56) References Cited

OTHER PUBLICATIONS

Interntional Preliminary Report on Patentability issued in the PCT Applciation No. PCT/US2021/061133 dated Jun. 15, 2023, 9 pages.

* cited by examiner

METHOD AND SYSTEM FOR AUTOMATED MULTI-ZONE DOWNHOLE CLOSED LOOP RESERVOIR TESTING

CROSS-REFERENCE TO RELATED APPLICATIONS

The present application is a divisional of co-pending U.S. patent application Ser. No. 18/254,240, filed May 24, 2023, which is a national stage entry of International Application No. PCT/US2021/061133, filed on Nov. 30, 2021, which claims priority to and benefit of European Patent Application No. 20306465.4 filed Nov. 30, 2020, the entirety of which is incorporated by reference herein and should be considered part of this specification.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. Data representative of various downhole parameters, such as downhole pressure and temperature, are often monitored and communicated to the surface during operations before, during and after completion of the well, such as during drilling, perforating, fracturing and well testing operations. In addition, control information often is communicated from the surface to various downhole components to enable, control or modify the downhole operations. Wireless communication systems, such as an acoustic communication system, can be deployed downhole to enable the exchange of information or messages between downhole components and surface systems.

One type of well testing operation that may be performed is a Drill Stem Test (DST), where information about the hydrocarbon formation is derived from pressure data obtained downhole during the testing operation.

SUMMARY

Certain embodiments of the present disclosure are directed to a method of performing an operation in a wellbore. The method includes running a toolstring in a wellbore that extends from a surface and penetrates a hydrocarbon-bearing formation that includes an upper zone and a lower zone. The toolstring includes a plurality of tools to perform an operation in the wellbore, including first and second packers, first and second fluid valves, and a fluid flow device. The fluid flow device includes a cylindrical housing having a wall defining an internal passageway for an axial fluid flow through the housing. Fluid ports extend through the wall to provide a path for a radial fluid flow to exit the internal passageway when the ports are open. The method further includes positioning the toolstring in the wellbore so that the first packer and the second packer straddle the upper zone, the first fluid valve and the second fluid valve straddle the upper zone, and the fluid flow device is adjacent the upper zone. The first packer is set to create a fluid flow barrier between the upper zone and an annulus of the wellbore surrounding the toolstring. The second packer is set to create a fluid flow barrier between the upper zone and the lower zone. The first fluid valve is closed to prevent a fluid flow through the toolstring to the surface, and the second fluid valve and the ports of the fluid flow device are opened to create a closed path for the hydrocarbon fluid to flow from the lower zone and into the upper zone. The method also includes perforating the lower zone.

Further embodiments of the present disclosure are directed to a system for performing an operation in a wellbore. The system includes a hub device to control and monitor a downhole operation in a wellbore that extends from a surface and penetrates a hydrocarbon formation having an upper zone and a lower zone. The system also includes a toolstring having multiple downhole tools located in the wellbore to perform actions associated with the downhole operation. The system further includes wireless repeaters communicatively coupled to a wireless transmission medium extending between the hub device and the downhole tools. The wireless repeaters can communicate with respective downhole tools and respond to a multiple hop query generated by the hub device. The multiple hop query includes multiple commands directed to targeted downhole tools. The hub device can generate a multiple hop query that directs the targeted downhole tools to create a closed loop fluid path for hydrocarbon fluids to flow from the lower zone and into the upper zone during the well operation.

Yet further embodiments of the present disclosure are directed to a method of testing a hydrocarbon well. The method includes deploying a test string in a wellbore that extends from a surface and penetrates a hydrocarbon bearing formation that includes an upper zone and a lower zone. The test string includes a tubing, downhole tools to perform activities associated with a well test and acoustic repeaters coupled to the tubing and acoustically coupled with the downhole tools. The method further includes deploying a hub device in the wellbore that is communicatively coupled with surface equipment via a wired transmission medium and communicatively coupled with the acoustic repeaters via an acoustic transmission medium. The method also includes generating, by the hub device, commands directed to the downhole tools that cause the downhole tools to create a closed loop fluid flow path for hydrocarbon fluids to flow from the lower zone and into the upper zone during the well test.

BRIEF DESCRIPTION OF THE DRAWINGS

Certain embodiments are described with reference to the accompanying drawings, wherein like reference numerals denote like elements. It should be understood, however, that the accompanying drawings illustrate the various implementations described herein and are not meant to limit the scope of various technologies described herein. The drawings show and describe various embodiments of the invention.

DETAILED DESCRIPTION

Figure 1:
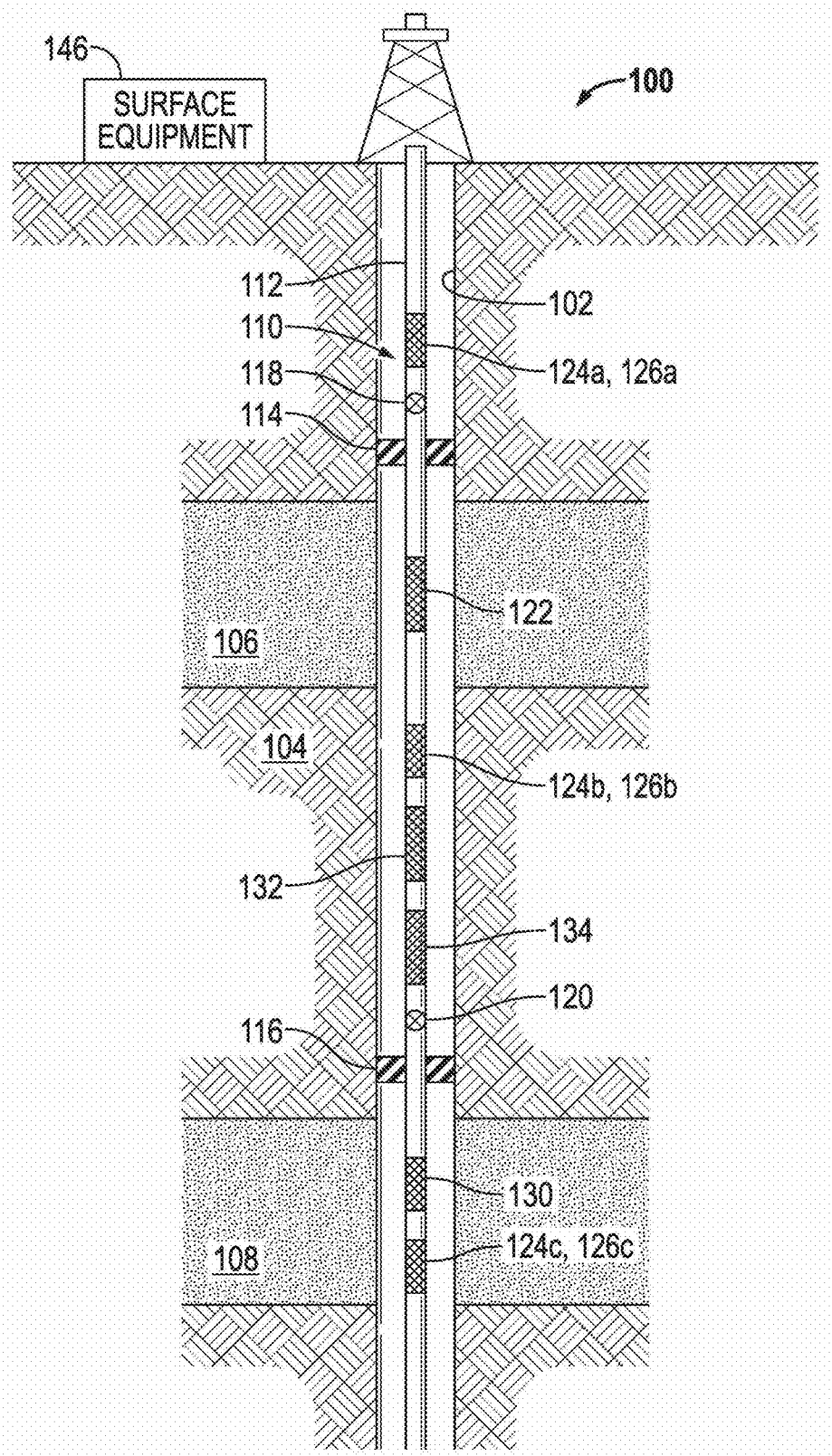
FIG. 1 is a schematic illustration of an example of a test toolstring deployed in a wellbore, according to an embodiment.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

There are many hydrocarbon reservoirs and wells where two or more zones were discovered during drilling and formation testing from which hydrocarbons may be produced. In many instances, the well operator decides to produce hydrocarbons from one zone at a time and plugs the other zones (e.g., the lower zones). Once the selected zone is depleted, the operator may desire to unplug the lower zones for testing.

Well testing generally involves the process of recovering reservoir information based on pressure data collected by downhole sensors. Information that can be recovered includes skin, effective permeability and information concerning the geology and connectivity of boundary systems as they expand away from the wellbore. One type of well test that is often performed is called a drill stem test (DST). Although well testing provides valuable information for the operator, the testing can be costly in terms of the time and equipment needed. In addition, the fluids produced during the testing can create environmental concerns.

To illustrate, during a well test, a pressure disturbance is created that can be recorded by a gauge that is located either downhole (to measure bottom hole pressure or BHP) or at the surface (to measure well head pressure or WHP). This pressure disturbance can be created through a process where the hydrocarbon reservoir is produced (referred to as "drawdown") and then shut in (referred to as "buildup"). Generally the well test is carried out using surface well test equipment. A typical well test may include multiple modes or phases, such as clean-up, initial build up, main flow and final build up. In the clean-up phase, the reservoir is drawn down with the goal of cleaning the perforations and clearing the wellbore of any drilling or completion fluids. During the build-up phases, the well is shut in to increase the bottom hole pressure. During the main flow phase, the well fluid is drawn down by opening the well at a constant rate with the effect of decreasing the bottom hole pressure.

Telemetry data obtained during the well test can provide information about both the well and the reservoir. For example, the production index and skin can be derived for the interval of the well being tested, and the average/effective permeability, heterogeneities (fractures, layering, properties), shapes and distances of boundaries, and average and initial pressures can be derived for the reservoir.

Performing a well test, such as a DST, requires a large amount of surface equipment and can present environmental challenges. For example, the draw down phase of the test involves the production of large amounts of fluid from the well. In existing well test systems, these fluids are stored in large storage tanks at the surface for later disposal. In locations where storage tanks are not available, the produced fluids are flared, thus releasing carbon dioxide to the atmosphere. Further, throughout the test, the surface test equipment collects and analyzes real-time telemetry data to verify the integrity of each phase of the test before proceeding to the next. Due to the large number of surface equipment needed (e.g., storage tanks and test equipment) and the complexity of the test equipment, well testing can be very costly.

The communication system used to convey telemetry data and commands during the well testing also introduces complexities and costs. Communication systems for transmitting information between the surface and downhole components in a well are faced with numerous challenges, some of which can be addressed by implementing a wireless communication system. One type of wireless communication system that can be deployed in a downhole environment is an acoustic communications system that uses an elastic medium as the communications path. The acoustic communication system can be used in multiple contexts, including testing, drilling or production operations, and can be used to transmit various types of information, such as telemetry information related to downhole measurements, tool status, actuation commands, etc. Generally, an acoustic communication system is considered for use when there is no apparent way to run a wired communications path between the communicating devices. The communicating devices may involve an operational team, where a computer (or control system) is used in the vicinity of the well (e.g., on a rig, waveglider, etc.) or at a remote location that is indirectly connected to a communication module connected to the acoustic network. In other implementations, the acoustic communication network can operate autonomously between the various oil and gas equipment.

In general, an acoustic communications network is composed of an arrangement of communication nodes in the form of acoustic modems that receive and transmit messages. The acoustic modems generally use a pipe string (or tubing) as the elastic transmission medium. The communication network is established by connecting a plurality of acoustic modems to tubing at axially spaced locations along the string. Each modem includes a transducer that can convert an electrical signal to an acoustic signal (or message) that is then communicated using the tubing as the transmission medium. An acoustic modem within range of a transmitting modem receives the acoustic message and processes it, including by demodulating and decoding the message. These modems are referred to as repeaters. A repeater's acoustic transducer and associated electronics can be packaged in a single cartridge that can be clamped to tubing in the wellbore. The power source for the repeater can be a battery.

In many well testing applications, the repeaters are placed on the tubing at spaced apart intervals, such that approximately 25 repeaters would be used for a 3000 meter well. Deploying this number of repeaters not only involves costly hardware and batteries, but also entails implementing complex network initiation and routing procedures and thus can be yet another factor contributing significantly to the cost and complexity of a well test.

Accordingly, embodiments disclosed herein are directed to well testing systems and methods. Embodiments of the disclosed system and method reduce the surface equipment needed for well testing, automate the well testing, simplify the acoustic communications network, and provide a closed loop system where the fluids produced during the test are not brought to the surface for storage or flaring but instead are disposed in a downhole zone, which can be a depleted zone, a dry zone or a producing zone. Consequently, the capital expenditure associated with well testing can be reduced and the surface equipment that would otherwise be used to handle the fluids produced during testing can be eliminated. Embodiments of the disclosed system and method can be used in many different applications, including for testing a multi-zone well, where at least a first zone previously has been depleted or found dry (or is even still producing) and a second lower zone is to be tested. It should be understood, however, that embodiments disclosed herein can be implemented in other applications, such as using a lower zone to stimulate and naturally fracture an upper zone.

Figure 2:
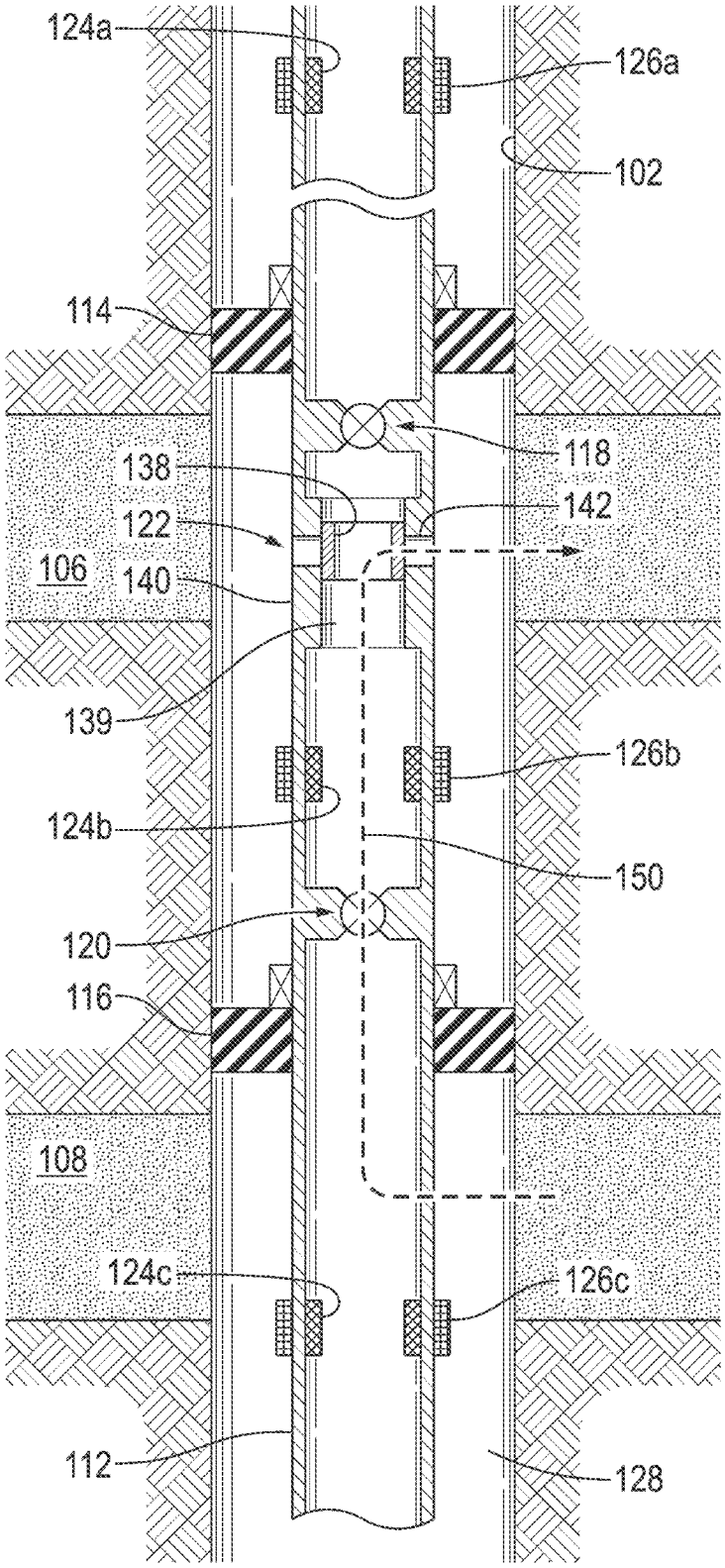
FIG. 2 is a schematic illustration showing additional detail of tools in the toolstring of FIG. 1, according to an embodiment.

An example of a well testing system 100, such as a DST system, deployed in a wellbore 102 is shown schematically in FIG. 1, with additional detail shown schematically in FIG. 2. Another example of a well testing system 500 deployed in the wellbore 102 is shown schematically in FIG. 8. In both FIGS. 1 and 8, the wellbore 102 penetrates a hydrocarbon-bearing formation 104 which, in these examples, includes a first upper zone 106 and a second lower zone 108. As shown, a toolstring or test string 110 has been deployed in the wellbore 102. In general, a toolstring can be divided in two sections: the major string, which is the longest part comprised mostly of the tubing that guides the flow of hydrocarbons from the reservoir to the surface; and the Bottom Hole Assembly (BHA) where the most sensitive equipment, such as sensors and gauges are located.

Figure 8:
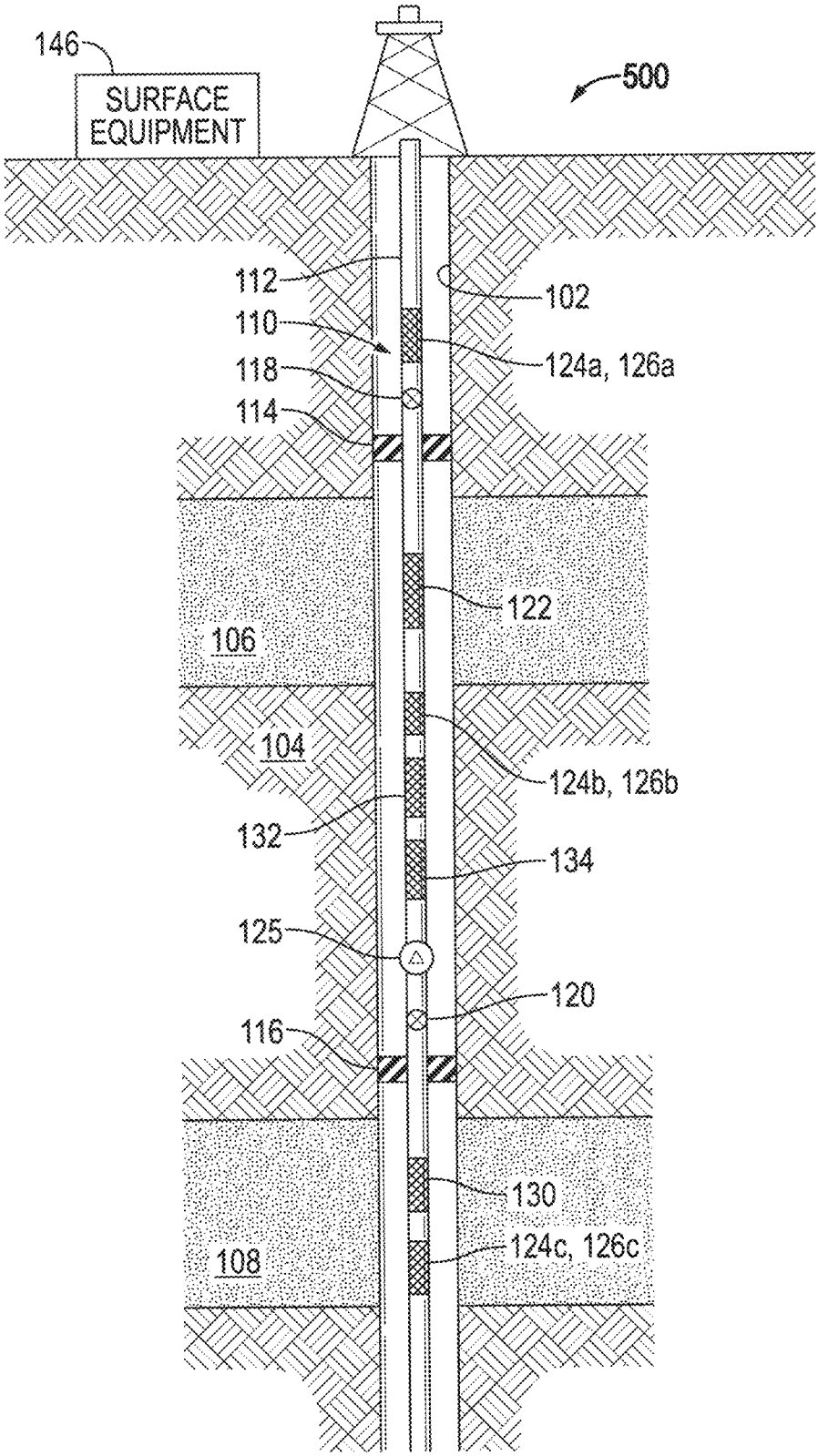
FIG. 8 is a schematic illustration of another example of a test toolstring deployed in a wellbore, according to an embodiment.

In the examples of FIGS. 1, 2 and 8, the test string 110 includes a tubing 112 and other pieces of test equipment, as will be described further below. In these examples, before the test string 110 was deployed in the wellbore 102, the upper zone 106 was either produced and depleted or found dry. In embodiments, the upper zone 106 can be re-perforated with wireline casing guns before testing, if desired. The upper zone 106 can also be a producing zone.

To perform the well test, the test string 110 is deployed in the wellbore 102. The string 110 includes a variety of pieces of equipment, including a first packer 114 and a second packer 116, tester valves 118 and 120, a sliding sleeve device 122, tubing pressure and temperature gauges 124*a-c*, annulus pressure and temperature gauges 126*a-c* within the annulus 128, a downhole adjustable choke 130, and various pieces of test equipment, such as fluid samplers 132 and flow meter 134. In the example of FIG. 8, the test string 110 also includes an electrical submersible pump (ESP) 125 that is deployed between upper zone 106 and lower zone 108.

As shown in FIGS. 1 and 8, packers 114 and 116 are set to straddle the upper zone 106. The packers 114 and 116 are retrievable packers and can be a rotation-to-set packer (i.e., a mechanical packer) or a non-rotation-to-set packer that is enabled by wireless (e.g., acoustic) information, such as by activating an electrical rupture disc. The packers 114 and 116 are used to temporarily create a barrier between zones 106 and 108 and/or create a barrier between a zone 106 or 108 and annular well control fluid (e.g., mud). In the examples shown, upper packer 114 serves to create a barrier between the annular well control fluid above the packer 114 and the upper zone 106 below the packer 114. The lower packer 116 serves to create a barrier between the upper non-productive zone 106 and the lower zone 108 below the packer 116.

After setting the packers 114 and 116, the upper test valve 118 is used to isolate the fluid flow from reaching the surface, thus enabling a closed loop or continuous injection flow path to be created between upper zone 106 and lower zone 108. Upper test valve 118 can also be used at the end of the well testing to kill the well and pull the test string 110 from the wellbore 102. The lower test valve 120 is used as the main valve during the well test to ensure the fluid flow from the lower zone 108 to the upper zone 106. The lower test valve 120 also is used to perform the pressure build-up of the lower zone 108 during the build-up phase of the well test.

The sliding sleeve device 122 is positioned between the upper packer 114 and lower packer 116. As shown in FIG. 2, the sliding sleeve device 122 generally includes a sleeve 138 slidable relative to a cylindrical housing 140 having an internal axial passageway 139 through which fluid can flow in the axial direction. The housing 140 includes one or more openings or ports 142 that extend through the wall of the housing 140 to provide a fluid flow path in the radial direction between the internal axial passageway 139 and the exterior of the housing 140 and thus allows fluid to flow from lower zone 108 into upper zone 106. The sleeve 138 is movable relative to the housing 140 between open and closed positions. In the open position of the sleeve 138, the ports 142 are exposed, thus allowing fluid to flow between the interior passageway and the exterior of the sleeve device 122. In the closed position of the sleeve 138, the ports 142 are closed, thus isolating the interior passageway from the region exterior of the sleeve device 122. In embodiments, the sleeve device 122 can be activated acoustically so that the sleeve 138 moves between open and closed positions (although other activation techniques can also be used, such as hydraulic activation).

In the examples of FIGS. 1, 2 and 8, after packers 114 and 116 are set to isolate zones 106 and 108, and the upper test valve 118 is closed, the sliding sleeve device 122 can be acoustically activated to the open position so that lower zone 108 can be tested. In the open position, ports 142 are open to upper zone 106, thus enabling fluid flow from lower zone 108 to upper zone 106, as denoted by dashed arrow 150.

The test string 110 also includes a variety of other acoustically enabled equipment to perform the well test, such as the pressure and temperature gauges 124*a-c*, 126*a-c*, the fluid samplers 132, the downhole flowmeter 134, and the downhole adjustable choke 130. In general, the pressure and temperature gauges 124*a-c*, 126*a-c* are used to acquire reservoir pressure and temperature during the different phases of the well test. The gauges 124*a-c*, 126*a-c* also can be used to verify and confirm the status of various operations performed during the well test, such as setting/unsetting of packers 114 and 116, opening/closing of test valves 118 and 120, opening/closing of sliding sleeve device 122, perforation of zone 108, etc. As shown in FIGS. 1 and 8, gauges 124*a-c*, 126*a-c* can be deployed at three (or more) different levels along the tubing 112: e.g., above upper test valve 118, between the upper and lower test valves 118 and 120, and below the lower test valve 120.

Fluid samplers 132 can be used to collect fluid samples during the flow phase of the test in which fluid is flowing from the lower zone 108. Flowmeter 134 can record and stream flow data in real time via the acoustic telemetry. Downhole choke 130 can be used to change the size of the choke during the fluid flow phase of the test. It should be understood that the toolstring 110 can include additional equipment or different equipment than the equipment described above, depending on the particular test being performed. For example, in the embodiment of FIG. 8, the toolstring 110 also includes ESP 125. When in the flow mode, if the pressure differential is not sufficient to drive the fluid flow from the lower zone 108 to the upper zone 106, the ESP 125 can be activated to thereby artificially increase the pressure differential.

In embodiments, an acoustic communications system is employed to enable communications between surface equipment 146 and the various downhole tools that make up the test string 110, including the transmission of telemetry and status data from the various gauges, samplers, valves, perforation guns, chokes, and so forth, as well as the transmission of commands from the surface equipment 146 to the downhole tools.

Figure 3:
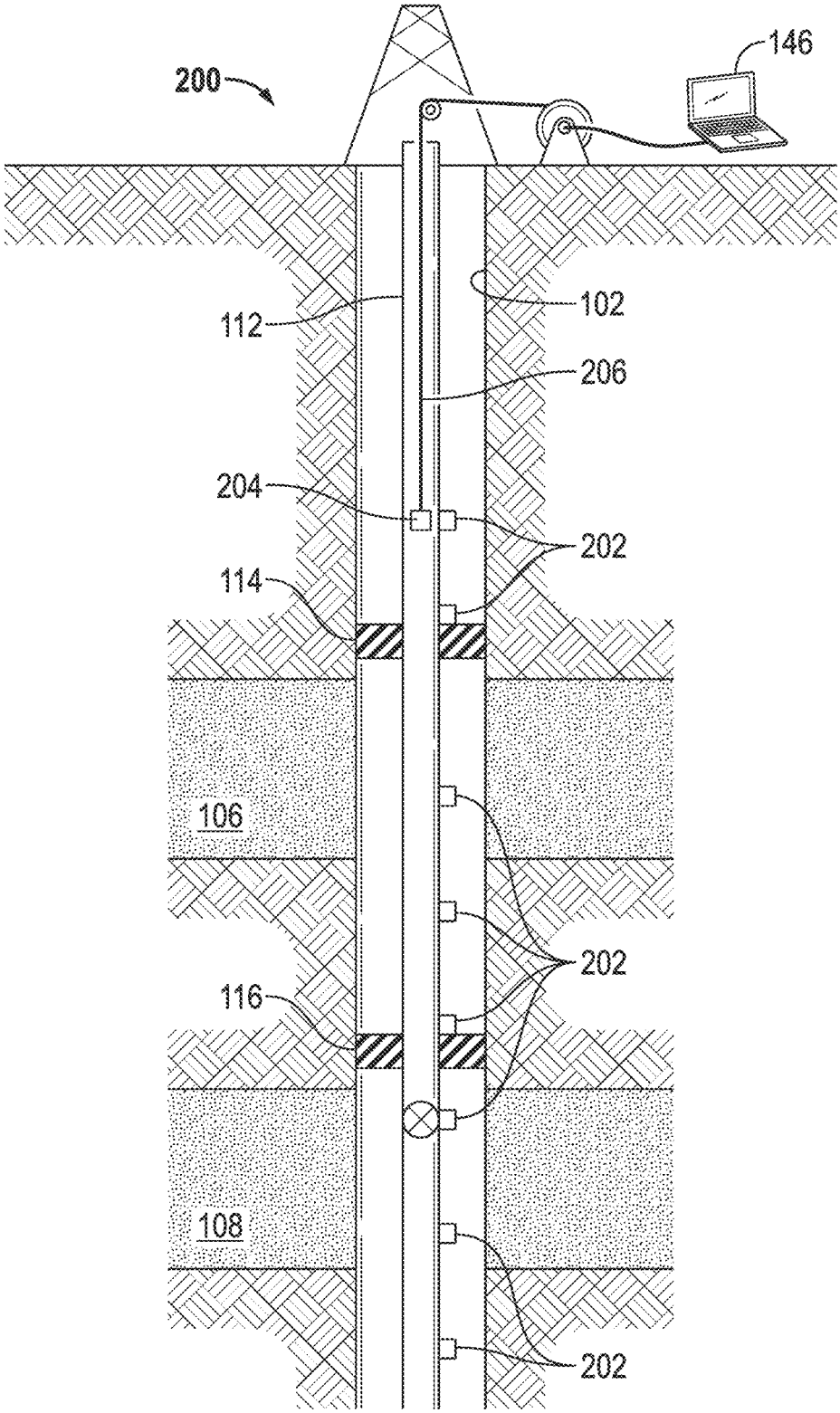
FIG. 3 is a schematic illustration of an acoustic communications network that can be used with the test toolstring of FIGS. 1 and 2, according to an embodiment.

FIG. 3 schematically illustrates an example of an acoustic communications system 200 that can be used in conjunction with the test string 110 of FIG. 1 or FIG. 8 to perform a well test. As shown in FIG. 3, the communications system 200 includes a plurality of repeaters 202 deployed at spaced intervals along the tubing 112. In general, a repeater 202 is made of electrical and mechanical components that provide the ability to transmit and receive acoustic signals that are exchanged between the surface and the downhole equipment.

Figure 7:
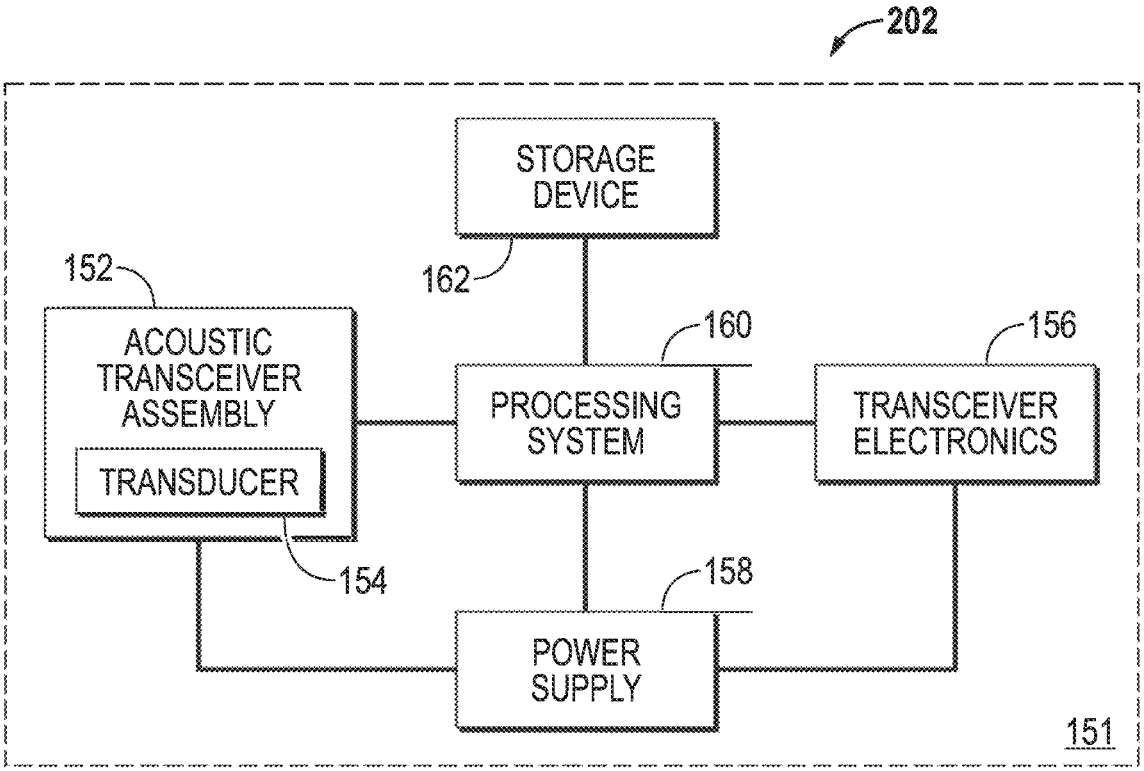
FIG. 7 is a schematic illustration of a repeater that can be deployed in the acoustic communications network of FIG. 3, according to an embodiment.

A schematic illustration of a repeater 202 is illustrated in FIG. 7. Repeater 202 includes a housing 151 that supports an acoustic transceiver assembly 152 that includes electronics and a transducer 154 which can be driven to create an acoustic signal in the tubing 112 and/or excited by an acoustic signal received from the tubing 112 to generate an electrical signal. The transducer 154 can include, for example, a piezoelectric stack, a magneto restrictive element, and/or an accelerometer or any other element or combination of elements that are suitable for converting an acoustic signal to an electrical signal and/or converting an electrical signal to an acoustic signal. The repeater 202 also includes transceiver electronics 156 for transmitting and receiving electrical signals. Power can be provided by a power supply 158, such as a lithium battery, although other types of power supplies are possible, including supply of power from a source external to the repeater 202.

The transceiver electronics 156 are arranged to receive an electrical signal from and transmit an electrical signal to the downhole equipment, such as the gauges 124, 126, valves 118, 120, ESP 125, and so forth. The electrical signal can be in the form of a digital signal that is provided to a processing system 160, which can encode and modulate the signal, amplify the signal as needed, and transmit the encoded, modulated, and amplified signal to the transceiver assembly 152. The transceiver assembly 152 generates a corresponding acoustic signal for transmission via the tubing 112.

The transceiver assembly 152 of the repeater 202 also is configured to receive an acoustic signal transmitted along the tubing 112, such as by another repeater 202. The transceiver assembly 152 converts the acoustic signal into an electric signal. The electric signal then can be passed on to processing system 160, which processes it for transmission as a digital signal to the downhole equipment. In various embodiments, the processing system 160 can include a signal conditioner, filter, analog-to-digital converter, demodulator, modulator, amplifier, encoder, decoder, microcontroller, programmable gate array, etc. The repeater 202 also can include a memory or storage device 162 to store data received from the downhole equipment so that it can be transmitted or retrieved from the repeater 202 later. Yet further, the memory or storage device 162 can store instructions of software for execution by the processing system 160 to perform the various well or well test operations described herein.

Returning to the example of FIG. 3, the acoustic communication system 200 has been simplified relative to conventional systems by reducing the number of repeaters 202 that otherwise would be deployed along the tubing 112. More particularly, rather than deploy repeaters 202 along the entire length of the tubing 112, a hub repeater 204 is lowered from the surface to the level of the bottom hole assembly and the upper zone 106. The hub repeater 204 is deployed from the surface using a cable 206, such as a wireline cable, a slickline or a fiber optic cable, that allows for non-wireless communications with the surface equipment 146. The cable 206 also can provide power to the hub repeater 204, thus eliminating the battery power source. Consequently, fewer power consumption limitations are placed on the hub repeater 204 so that it can incorporate higher computational power and storage capacity, providing for greater capabilities at a reduced cost.

In known systems, a conventional technique for actuating downhole tools and acquiring downhole data entails transmitting a single query directed to a specific target downhole and then waiting to receive a response from the target. This technique can be costly both in terms of speed and energy consumption.

Accordingly, embodiments described herein are directed to an efficient data harvesting technique, referred to here as "Multiple Hop Queries." In accordance with the Multiple Hop Queries technique, the hub repeater 204 assumes a supervisory (or master role) in the telemetry toolstring. Hub repeater 204 initiates a query that is composed of multiple simple queries, where each simple query is intended for a specific tool. As an example, a multiple hop query ("MHQ") could include a "close tester valve" command directed to the tester valve 118, an "obtain pressure data" request directed to a sensor 124, 126, and an "open sleeve" command directed to the sliding sleeve device 122. The hub repeater 204 transmits the MHQ, which is then routed through the acoustic network 200 in accordance with a predetermined routing algorithm (which may be based, for example, on current noise conditions, currently available repeaters, a default route, etc.). Each repeater 202 along the route that receives the MHQ verifies whether the MHQ includes a simple query addressed to that repeater. If so, the repeater 202 dequeues the MHQ, processes the simple query, queues the response to the query into the payload of the MHQ, and then transmits the MHQ (with the response) in accordance with the routing algorithm. Once the MHQ reaches the final repeater 202 in the network 200, the final repeater 202 compiles the responses into a final response message and directs the final response to the hub repeater 204. The hub repeater 204 then can transmit the final response to the surface acquisition equipment 146.

Figure 4:
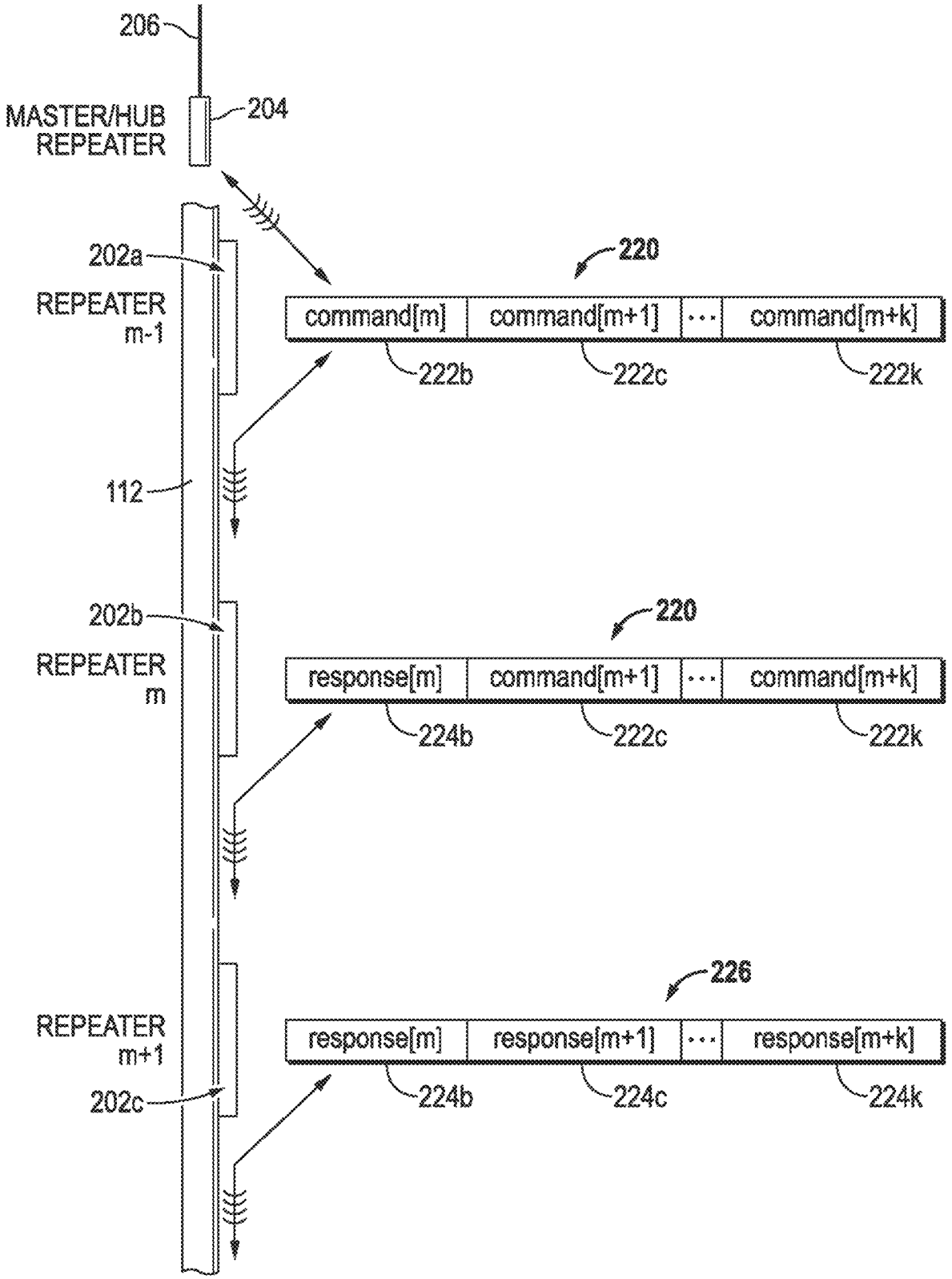
FIG. 4 illustrates a multi query hop data harvesting technique that can be used to conduct a well test, according to an embodiment.

A simplified example of the MHQ harvesting technique is shown in FIG. 4, in which the network 200 includes the master/hub repeater 204, repeater (m−1) 202*a*, repeater (m) 202*b*, repeater (m+1) 202*c*, and repeater (m+k) 202*k* (not shown), each coupled to an acoustic transmission medium, such as the tubing 112. In this example, the hub repeater 204 transmits an MHQ 220 that includes command (m) 222*b*, command (m+1) 222*c*, and command (m+k) 222*k*. Repeater (m−1) 202*a* receives the MHQ 220, verifies that the MHQ 220 does not include a command directed to it, and forward the MHQ 220 according to the routing algorithm. Repeater (m) 202*b* receives the MHQ 220, confirms that it includes a command (m) 222*b* directed to it, dequeues the MHQ 220 and processes the command (m) 222*b*, and then generates a response (m) 224*b* that it appends to the payload of the MHQ 220. MHQ 220 is then acoustically transmitted in accordance with the routing algorithm. Repeater (m+1) 202*c* receives MHQ 220, verifies that it includes a command (m+1) 222*c*, dequeues and processes the command (m+1) 222*c*, and then generates a response (m+1) 224*c* that it appends to the payload of MHQ 220. MHQ 220 is then acoustically transmitted in accordance with the routing algorithm. This process continues until the multiple hop query 220 (with the appended responses 224) reaches the final repeater (m+k) 202*k*. Repeater 202*k* compiles responses 224*b*-*k* into a message 226 that it then transmits back to the hub repeater 204.

In embodiments, the MHQ technique illustrated in FIG. 4 can be used to implement well testing using the tool string 110 in FIGS. 1, 2 and 8. Each of the components of the tool string 110 are interfaced to an acoustic telemetry network, such as the network 200 shown in FIG. 3.

To perform a well test (e.g., a DST) using the tool string 110 of FIGS. 1, 2 and 8, the network 200 of FIG. 3 and the MHQ technique of FIG. 4, a set of operation modes can be predefined that correspond to each phase of the well test. During each phase, a set of known tasks will be performed that can be translated into an MHQ. As an example, the phases of a drill stem test can correspond to a Pre-Perforation Mode, a Flowing Mode, a Build-Up Mode, and a Well Killing (Bullheading) Mode, among others.

Figure 5:
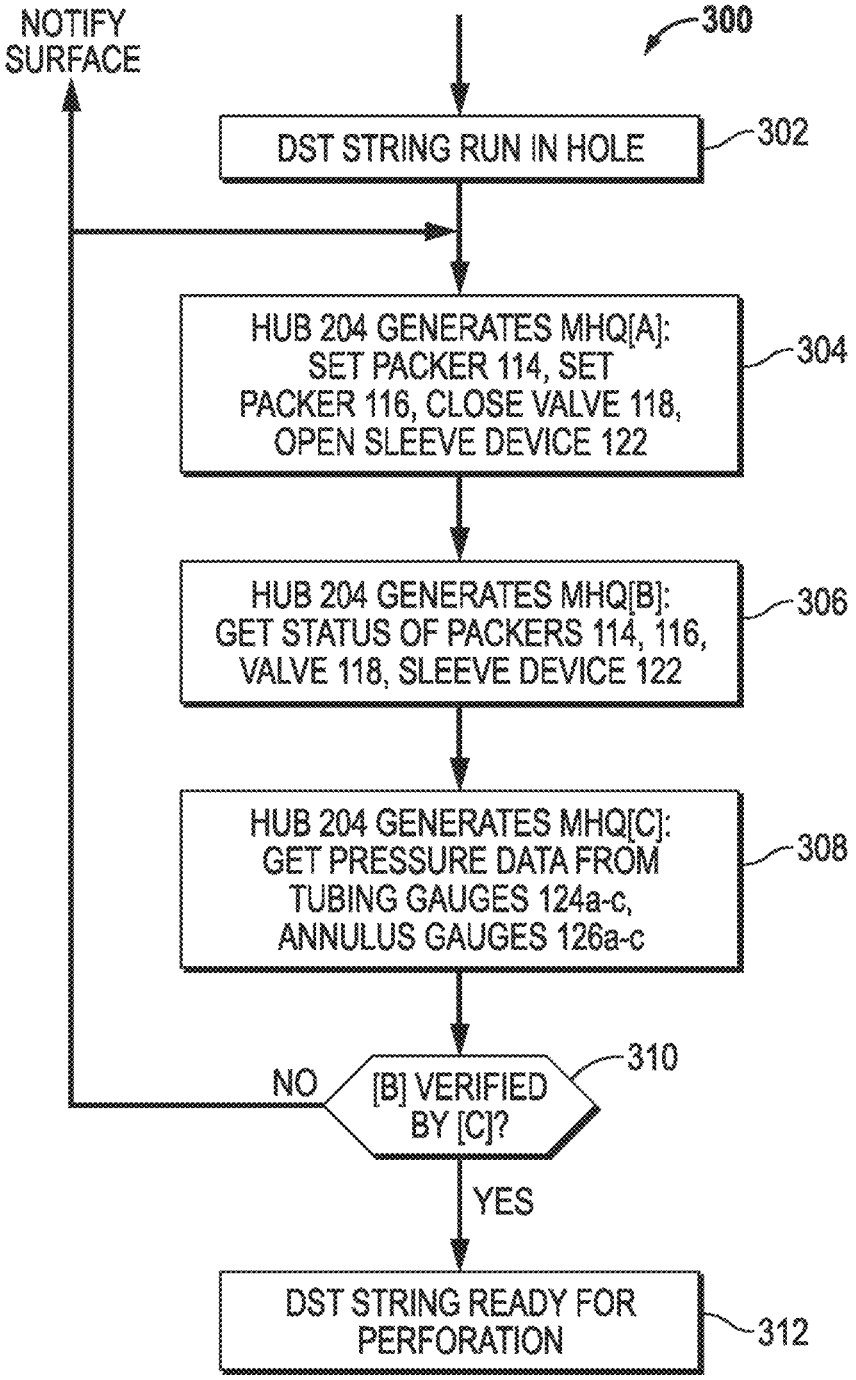
FIG. 5 is an example workflow for one mode of a well test, according to an embodiment.

FIG. 5 illustrates a workflow 300 for an exemplary Pre-Perforation Mode. At block 302, the DST string 110 and the hub repeater 204 have been run in the wellbore 102. At block 304, the hub repeater 204 generates and transmits on the acoustic telemetry network 200 an MHQ[A] that includes commands to "set packer 114," "set packer 116," "close tester valve 118" and "open sliding sleeve device 122". At block 306, the hub repeater 204 generates and transmits an MHQ[B] that includes queries to get the status of packers 114 and 116, tester valve 118 and sliding sleeve device 122. At block 308, the hub repeater 204 generates and transmits an MHQ[C] that includes queries to get the pressure data from annulus gauge 126*a*, tubing gauge 124*a*, annulus gauge 126*b*, tubing gauge 124*b*, annulus gauge 126*c* and tubing gauge 124*c*. At block 310, the hub repeater 204 examines the responses received from MHQ[B] and MHQ[C] to determine whether the pressure data confirms the status of the tools. If the status is not confirmed, the hub repeater 204 sends a notification message to the surface equipment 146 and re-starts the process at block 304. If the status is confirmed, then the DST string 110 is ready to perform perforation of lower zone 108 (block 312), and the perforation guns (not shown) can be activated.

Figure 6:
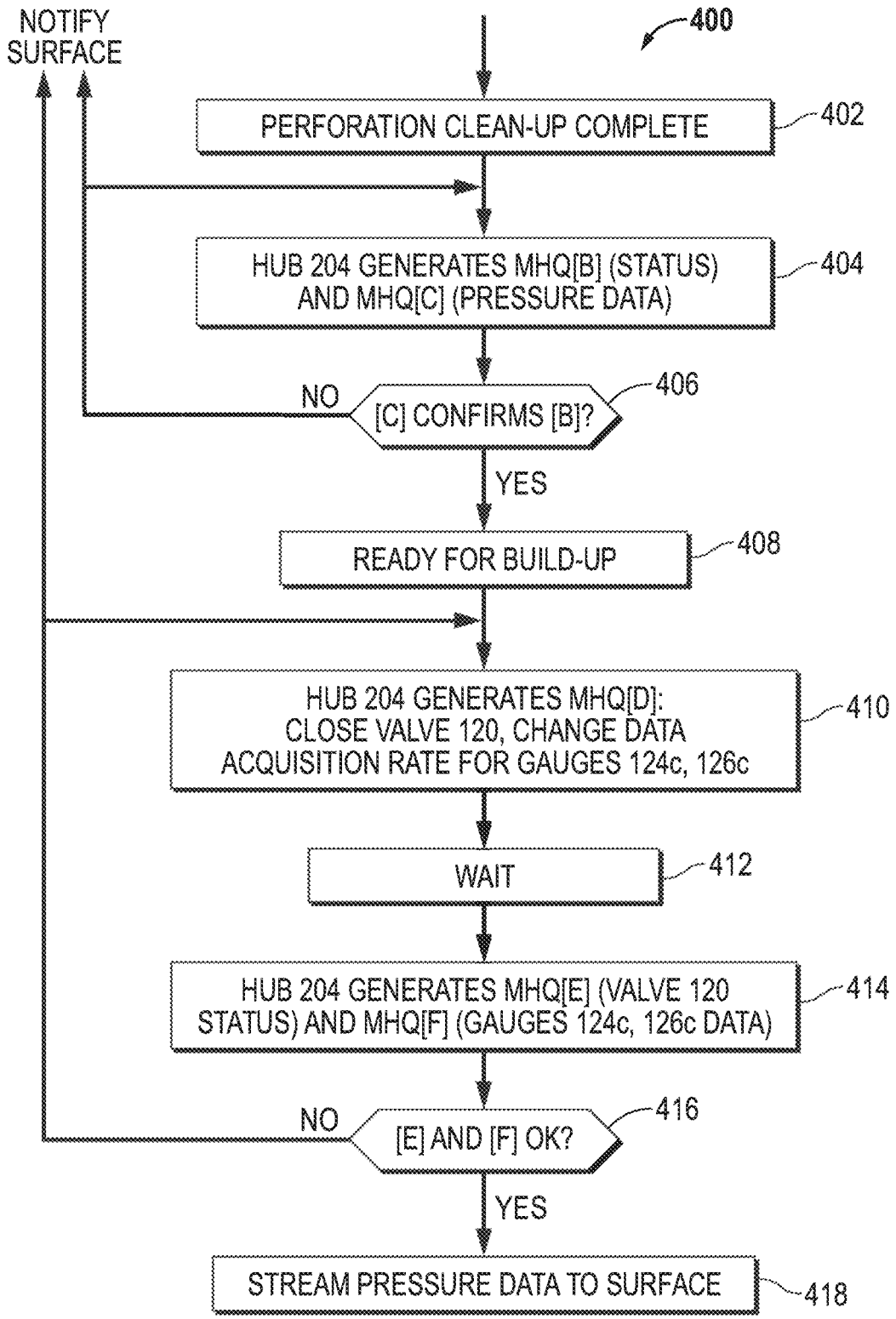
FIG. 6 is an example workflow for another mode of a well test, according to an embodiment.

The next phase of the DST test corresponds to the Build-Up Mode, in which the lower zone 108 is shut in so that the bottom hole pressure can build up. An exemplary workflow 400 for the Build-Up Mode is illustrated in FIG. 6. After perforation of lower zone 108 and any cleanup is complete (block 402), the hub repeater 204 generates and transmits MHQ[B] and MHQ[C] in order to obtain the status of the various tools and the pressure data from the various gauges 124*a*-*c*, 126*a*-*c* (block 404). At block 406, the hub repeater 204 compares the responses received in response to the MHQ[B] and MHQ[C] to determine whether the pressure data confirms the status of the tools. If the status is not confirmed, the hub repeater 204 notifies the surface equipment 146 and re-starts the process at block 404. If the status is confirmed, then the DST test is ready to build up the bottom hole pressure (block 408).

At block 410, the hub repeater 204 generates an MHQ[D] with multiple commands, including to close tester valve 120 and to change the rate at which pressure data is acquired from tubing gauge 124*c* and annulus gauge 126*c*. For example, the MHQ[D] may command the tubing and annulus gauges 124*c*, 126*c* to provide pressure data at a fast rate (e.g., 1 second) for an initial short interval of the build-up phase (e.g., 10 minutes), a slower rate (e.g., 10 seconds) for a second interval (e.g., 1 hour), and then a much slower rate (e.g., 2 minutes) during the remainder of the pressure build-up period (e.g., 3 hours). After transmitting MHQ[D], the hub repeater 204 waits a short period to allow the pressure to build (e.g., 10-20 seconds) (block 412). Then, the repeater hub 204 generates an MHQ[E] requesting the status of valve 120 and pressure data from gauges 124*c*, 126*c* (block 414). If the responses indicate that the tester valve 120 is closed and the pressure is building (block 416), then the hub repeater 204 will stream the pressure data to the surface equipment 146 (block 418). Otherwise, the hub repeater 204 notifies the surface equipment 146 and re-starts the process at block 410.

In embodiments, the hub repeater 204 can also be configured to detect any anomalies in the pressure build-up during the Build-Up Mode (e.g., a leak, plug, etc.) If an anomaly is detected, the hub repeater 204 notifies the surface equipment 146.

The next phase of the DST test corresponds to the Flow Mode. In the Flow Mode, the adjustable downhole choke 130 is set to a particular size and the tester valve 120 is opened so that fluid can flow from lower zone 108 and into upper zone 106 through the slidable sleeve device 122. In this mode, the hub repeater 204 again generates MHQs to query the status of the downhole tools and to obtain pressure and/or flow data. The MHQs can include commands to vary the size of the choke 130 and, if desired, to acquire fluid samples. In the example of FIG. 8, if the pressure data obtained in response to the MHQs indicates that the pressure differential between upper zone 106 and lower zone 108 is less than a predetermined minimum differential, then the MHQs can include a command to activate the ESP 125 to ensure a continuous injection of fluid into zone 106 from zone 108.

At the end of the Flow Mode, the DST test proceeds to the Kill Well Mode. In this Mode, the hub repeater 204 generates an MHQ with multiple commands, such as "open tester valve 120," "wait 30 seconds," "open tester valve 118," "wait 30 seconds," "open sliding sleeve 122," "wait 30 seconds," and "open choke 130 fully." The hub repeater 204 can then generates an MHQ requesting the status of each of the tools to which the commands were sent. Hub repeater 204 can also generate an MHQ requesting pressure data from each of the gauges. If the pressure data confirms the status of the tools, then bullheading can be started to kill the well. Otherwise, the hub repeater 204 notifies the surface equipment 146 and re-starts the Kill Well Mode process.

In embodiments, the DST test (or any other well test) described above can be performed automatically (i.e., without user intervention). In the automatic mode, the surface system 146 can send an executable file to the hub repeater 204 that contains the well test program, with details of the various modes, including the durations and the mode parameters. The hub repeater 204 can then execute the program, including generating an MHQ to activate the tools required for each particular phase of a mode. Once the tools for the current phase or mode are activated, the hub repeater 204 can generate MHQs to obtain tool status and acquire telemetry data. Data obtained by the hub repeater 204 can then be sent to the surface system 146 for display and real-time interpretation.

In embodiments, the automatic mode can be interrupted by the well test operator. For example, an operator can interrupt the well test at any time and send a specific acoustic command to a specific downhole tool. The interruption can be for verification, program changes, troubleshooting or any other purpose. Further, the interruption mode can be temporary or permanent (i.e., cancelling the automatic execution of the well test program). If permanent, a new well test program can then be transmitted to the hub repeater 204 for execution.

Although embodiments have been described in the context of drill stem testing, it should be understood that the techniques can be used with other types of well tests or operations. Further, the test may include different or additional phases or modes than those described above, and the various actions taken in each phase can be different than those described above or may be performed in different orders. Yet further, it should be understood that the closed loop well test technique can be implemented using communication networks other than the acoustic communications network 200. Still further, it should be further understood that the techniques described herein can be implemented in a variety of wireless communications systems, and that the physical layer of the communication is not limited to the acoustic telemetry system that has been described above.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method of performing an operation in a wellbore, comprising:

running a toolstring in a wellbore that extends from a surface and penetrates a hydrocarbon-bearing formation, the formation including an upper zone and a lower zone, wherein the toolstring includes a plurality of tools to perform an operation in the wellbore, the tools including:

a first packer and a second packer;

a first fluid valve and a second fluid valve; and a fluid flow device, wherein the fluid flow device includes a cylindrical housing having a wall defining an internal passageway for an axial fluid flow through the housing, and a plurality of ports extending through the wall to provide a path for a radial fluid flow to exit the internal passageway when the ports are open;

positioning the toolstring in the wellbore so that the first packer and the second packer straddle the upper zone, the first fluid valve and the second fluid valve straddle the upper zone, and the fluid flow device is adjacent the upper zone;

setting the first packer to create a fluid flow barrier between the upper zone and an annulus of the wellbore surrounding the toolstring;

setting the second packer to create a fluid flow barrier between the upper zone and the lower zone;

closing the first fluid valve to prevent a fluid flow through the toolstring to the surface;

opening the second fluid valve and the ports of the fluid flow device to create a closed path for the hydrocarbon fluid to flow from the lower zone and into the upper zone; and perforating the lower zone.

2. The method as recited in claim 1, wherein the upper zone is depleted or dry of a hydrocarbon fluid, and the lower zone contains a hydrocarbon fluid.

3. The method as recited in claim 1, wherein the operation is a well test.

4. The method as recited in claim 3, wherein the well test is a drill stem test, and wherein the toolstring is operated in a plurality of modes during the drill stem test, including a pre-perforation mode in which status of the tools is verified, a fluid flow mode in which fluid flows from the lower zone into the upper zone, and a build-up mode in which fluid pressure in the wellbore is built up.

5. The method as recited in claim 4, wherein the toolstring includes an electrical submersible pump positioned between the upper zone and the lower zone, and the method further comprises activating the electrical submersible pump in the fluid flow mode to drive fluid flow from the lower zone into the upper zone.

6. The method as recited in claim 3, further comprising deploying an acoustic communications network in the wellbore, the network including a hub repeater coupled to a surface system by a wired connection and a plurality of acoustic repeaters coupled to the tubing at spaced apart intervals, wherein the acoustic repeaters communicate using the tubing as an elastic communications medium.

7. The method as recited in claim 6, wherein the hub repeater includes a processing system and a storage device containing instructions corresponding to the well test that are executable by the processing system, and the method further comprises automatically executing the instructions to perform the well test, wherein executing the instructions includes generating by the hub repeater a multiple hop query including a plurality of queries directed to a plurality of different tools in the toolstring.

* * * * *